US005749755A

United States Patent [19]

Genta et al.

[11] Patent Number: 5,749,755

[45] Date of Patent: May 12, 1998

[54] FEMALE ELECTRIC TERMINAL

[75] Inventors: Alessandro Genta, Turin; Renzo Rampone, Moncalieri, both of Italy

[73] Assignee: Framatome Connectors International S.A., Courbevoie, France

[21] Appl. No.: 628,697

[22] PCT Filed: Oct. 17, 1994

[86] PCT No.: PCT/EP94/03416

§ 371 Date: Apr. 17, 1996

§ 102(e) Date: Apr. 17, 1996

[87] PCT Pub. No.: WO95/11535

PCT Pub. Date: Apr. 27, 1995

[30] Foreign Application Priority Data

Oct. 18, 1993 [IT] Italy ..... TO93 A 000768

[51] Int. Cl.[6] ..... H01R 13/11

[52] U.S. Cl. ..... 439/856

[58] Field of Search ..... 439/856, 857, 439/858, 861, 862, 845, 849, 850, 851

[56] References Cited

U.S. PATENT DOCUMENTS

| | | | |
|---|---|---|---|
| 4,175,821 | 11/1979 | Hunter | 439/856 |
| 4,720,276 | 1/1988 | Takahashi | 439/856 |
| 4,963,102 | 10/1990 | Gettig et al. | 439/856 |
| 5,162,004 | 11/1992 | Kuzuno et al. | 439/856 |
| 5,269,712 | 12/1993 | Denlinger et al. | 439/845 |
| 5,554,056 | 9/1996 | Henricus op ten Berg | 439/857 |

FOREIGN PATENT DOCUMENTS

| | | | |
|---|---|---|---|
| 1490561 | 4/1969 | Germany | 439/850 |
| 3636711 | 5/1988 | Germany | 439/851 |

*Primary Examiner*—Gary F. Paumen
*Assistant Examiner*—Tho Dac Ta
*Attorney, Agent, or Firm*—Pollock, Vande Sande & Priddy

[57] ABSTRACT

A female electric terminal made of conductive sheet metal. The terminal has a contact body with contact first and second flexible blades which project from opposite walls of the contact body and which cooperate with a male terminal and a portion for connection to an electric cable. The blades define a gap smaller than the thickness of the male terminal. The male terminal is inserted into the gap and the blades cooperate elastically with opposite faces of the male terminal. The first and second blades are asymmetrical so as to define transversely offset contact areas on the respective faces of the male terminal.

6 Claims, 3 Drawing Sheets

FEMALE ELECTRIC TERMINAL

FIELD OF THE INVENTION

The present invention relates to an electric terminal, particularly a female electric terminal designed to mate with a male blade type terminal.

DESCRIPTION OF THE RELATED ART

Female electric terminals made by blanking and bending conductive sheet metal are known, and comprise, integrally, a contact body with contact elements cooperating with a male blade terminal, and a deformable portion for connection to an electric cable.

More specifically, the contact elements consist of one or more pairs of blades projecting from the contact body and cooperating with respective opposite faces of the male terminal. The contact blades of female terminals of the type briefly described above are symmetrical in relation to the plane of the male terminal so as to cooperate with facing contact areas on either side of the terminal.

Terminals of the aforementioned type are only suitable for use with flat blade male terminals as opposed to those with shaped blades, e.g. those having ridged cross sections which are becoming increasingly popular because they require less material for given mechanical characteristics.

SUMMARY OF THE INVENTION

It is an object of the present invention to provide a female terminal designed to overcome the aforementioned limitation and, in particular, to cooperate with male terminals having either flat or shaped blades.

According to the present invention, there is provided a female electric terminal made of conductive sheet metal. The terminal comprises integrally, a contact body with contact means which cooperate with a male terminal and a portion for connection to an electric cable. The said contact means has first and second flexible blade means projecting from opposite walls of the contact body and cooperating elastically with respective opposite faces of the male terminal. The first and second blade means are asymmetrical in relation to the plane of the male terminal so as to define offset contact areas on the respective faces of the male terminal. The first and second blade means have respective flexible portions of at least substantially the same flexural rigidity.

BRIEF DESCRIPTION OF THE DRAWINGS

Two preferred, non-limiting embodiments of the present invention will be described by way of example with reference to the accompanying drawings, in which.

DETAILED DESCRIPTION OF THE PREFERRED EMBODIMENT

Figure 1:
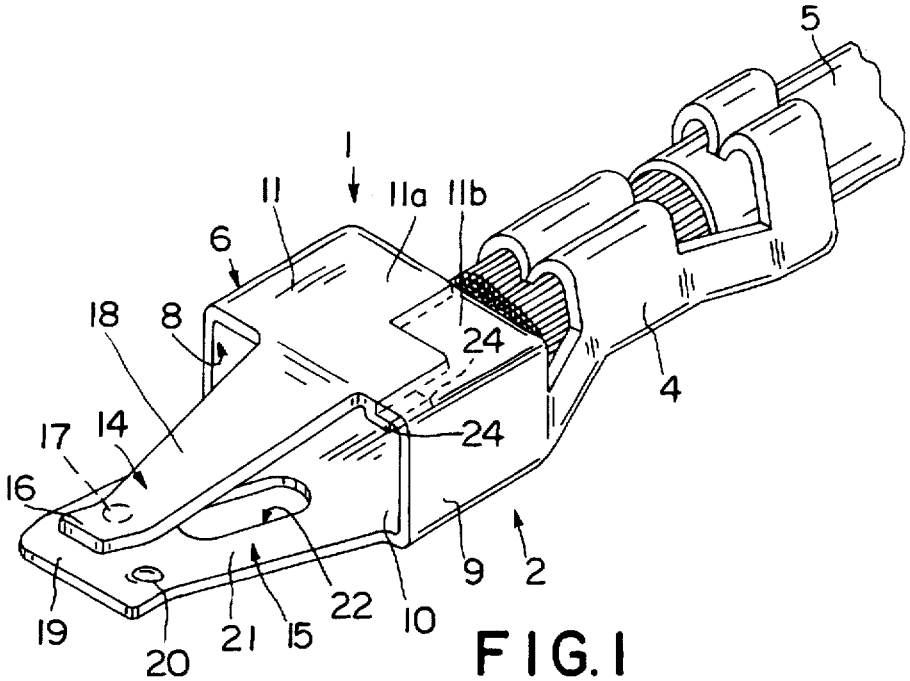
FIG. 1 shows a view in perspective of a first embodiment of a female electric terminal in accordance with the teachings of the present invention.

Number 1 in FIG. 1 indicates a female electric terminal 1. It should be stressed that terms such as "top", "bottom", "front", "rear" and similar in the following description are in no way limiting and are used purely for reasons of clarity with reference to the position of terminal 1 as shown in FIG. 1.

Terminal 1 is formed in one piece from conductive sheet metal by means of blanking, pressing and bending operations.

Figure 2:
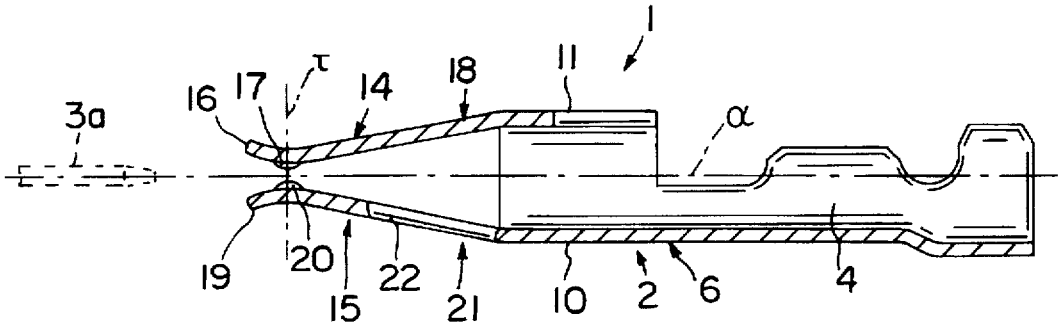
FIGS. 2, 3, 4 and 5 respectively show a longitudinal half section, a top plan view, a bottom plan view, and a front view of the FIG. 1 terminal.

Terminal 1 substantially comprises a contact body 2 designed to cooperate indifferently with a flat blade male terminal 3*a* (FIGS. 2, 6) or with a terminal 3*b* featuring a shaped, ridged cross section blade (FIG. 7); and with a deformable portion 4 for connection to an electric cable 5.

Figure 5:
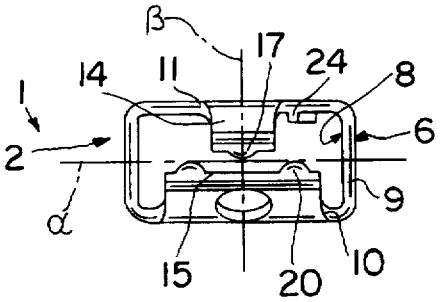

Body 2 substantially comprises a box portion 6 with a closed rectangular cross section, from which connecting portion 4 extends rearwards. Box portion 6 comprises a bottom wall 10 and a top wall 11 parallel to each other and to a plane a defining, in use, the plane of male terminal 3*a* or 3*b*. A pair of lateral walls 8, 9 are provided parallel to each other and perpendicular to plane a (FIG. 5).

From top and bottom walls 11, 10 of body 2, there projects frontwards curved contact blades 14, 15 with their convex sides facing each other, and which, when undeformed, define a gap smaller than the thickness of male terminal 3*a* or 3*b*.

According to the present invention, blades 14, 15 are asymmetrical in relation to plane $\alpha$ so as to define offset contact areas on the opposite faces of terminal 3*a* or 3*b*.

Figure 3:
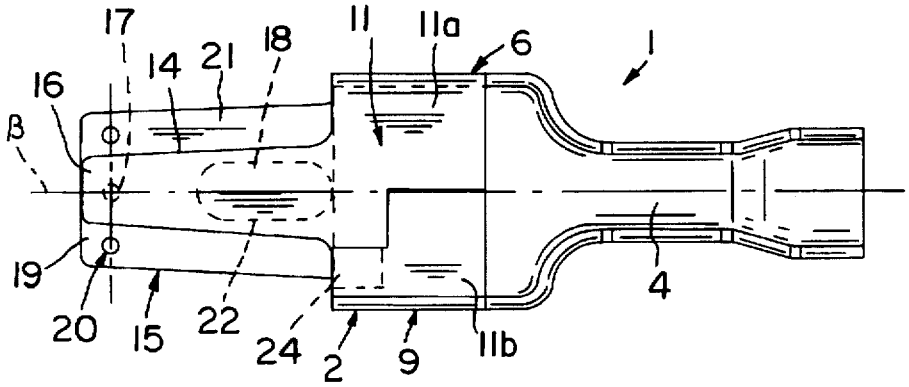

More specifically, when viewed from above (FIG. 3), top blade 14 is symmetrical in relation to the longitudinal mid plane $\beta$ perpendicular to plane $\alpha$, and tapers linearly towards an end portion 16 where it presents a contact 17 defined by a spherical-bowl-shaped impression with its center in plane $\beta$. A portion 18 of blade 14, extending between end portion 16 and wall 11, is flexible upon insertion of the male terminal.

Figure 4:
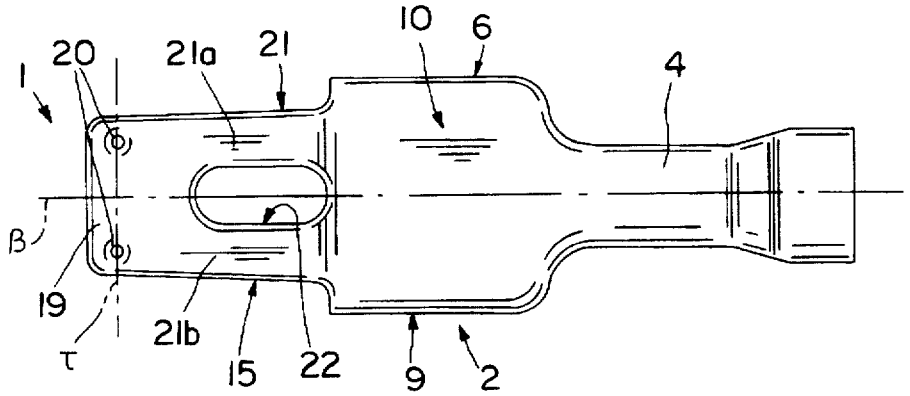

When viewed from below (FIG. 4), blade 15 is symmetrical in relation to plane $\beta$, tapers linearly towards end portion 19, is wider than blade 14, and presents, on end portion 19, two contacts 20 similar to contact 17, located symmetrically in relation to plane $\beta$, and with their respective centers in a transverse plane $\tau$ perpendicular to planes $\alpha$ and $\beta$ and through the center of contact 17. A portion 21 of blade 15, extending between end portion 19 and wall 10, is flexible upon insertion of the male terminal, and presents a longitudinal slot 22 by which portion 21 is divided into two side by side longitudinal portions 21*a*, 21*b*.

According to the present invention, blades 14 and 15 are equally deformable upon insertion of terminal 3*a* or 3*b* so as to transmit balanced elastic reactions to the respective faces of the terminal.

For this purpose, the elastically deformable portions 18, 21 of blades 14, 15, respectively, present the same flexural rigidity, i.e. for a given thickness. The width of portions 21*a*, 21*b* is equal to half the width of portion 18 measured in the same transverse plane.

Top wall 11 consists of two portions 11*a*, 11*b* integral with respective lateral walls 9 and bent 90° towards each other so as to mate end to end.

Portion 11*a*, from which blade 14 originates, preferably presents an end appendix 24 below the plane of wall 11 and designed to fit beneath portion 11*b*.

Figure 8:
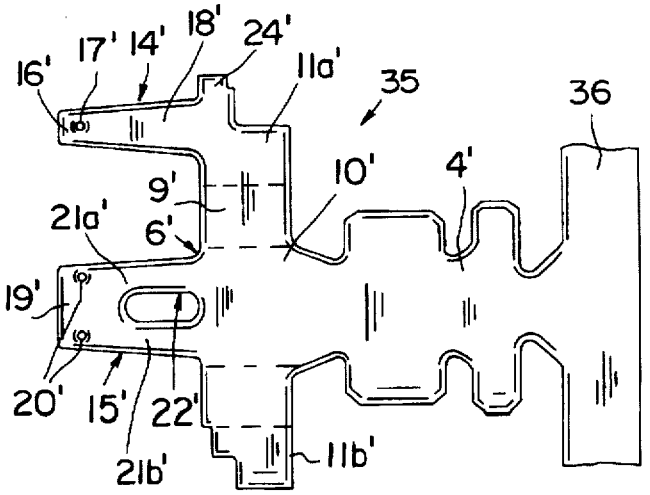
FIG. 8 shows a flat sheet metal blank from which to produce the FIG. 1 terminal.

FIG. 8 shows a flat blank 35 of terminal 1 formed by blanking a strip of conductive sheet metal, and extending integrally and transversely from a feed and guide band 36 to which is connected a succession of equally spaced identical blanks (not shown).

For the sake of clarity, the various parts of blank 35 are indicated using the same numbering system, plus a ('), as for the corresponding components of the finished terminal in FIGS. 1 to 7.

Figure 6:
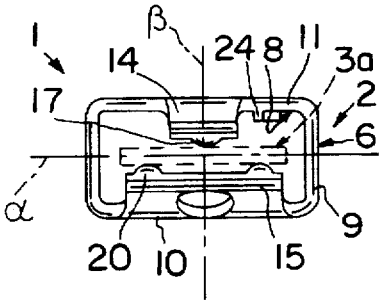
FIGS. 6 and 7 show front views of the FIG. 1 terminal engaged by a flat blade and a ridged cross section blade male terminal respectively.

FIG. 6 shows a cross section of terminal 1 engaged by a flat blade terminal 3*a*. Contact 17 cooperates with a central portion of one face of terminal 3*a* and contacts 20 cooperate with lateral portions of the opposite face.

Figure 7:
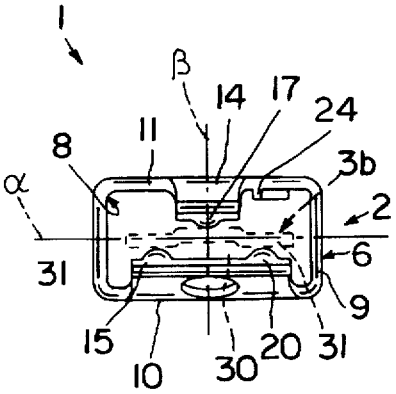

FIG. 7 shows a cross section of terminal 1 engaged by a terminal 3*b* with a shaped blade having a ridged cross section with a central rib 30 and two lateral wings 31 offset in relation to rib 30. Though made of thinner material as compared with terminal 3*a*, terminal 3*b* presents the same mechanical characteristics by virtue of its ridged structure. In this case, contact 17 cooperates with rib 30, on the face projecting in relation to wings 31, while contacts 20 cooperate with the opposite face of respective wings 31. Since the distance between the planes of the contact faces of terminal 3*b* is typically equal to the thickness of terminal 3*a*, deformation of blades 14, 15 upon insertion of terminal 3*a* or 3*b* is identical in both cases and hence results in the same contact pressure. Consequently, electric and mechanical performance of terminal 1 is identical in both cases.

The dual connection characteristic is made possible by the arrangement described above of contacts 17, 20, and the fact that, as a result, blades 14, 15 are asymmetrical in relation to plane. This in no way impairs operation of terminal 1, by virtue of blades 14, 15 exerting balanced elastic forces on male terminal 3*a* or 3*b* during insertion of the terminal.

Figure 9:
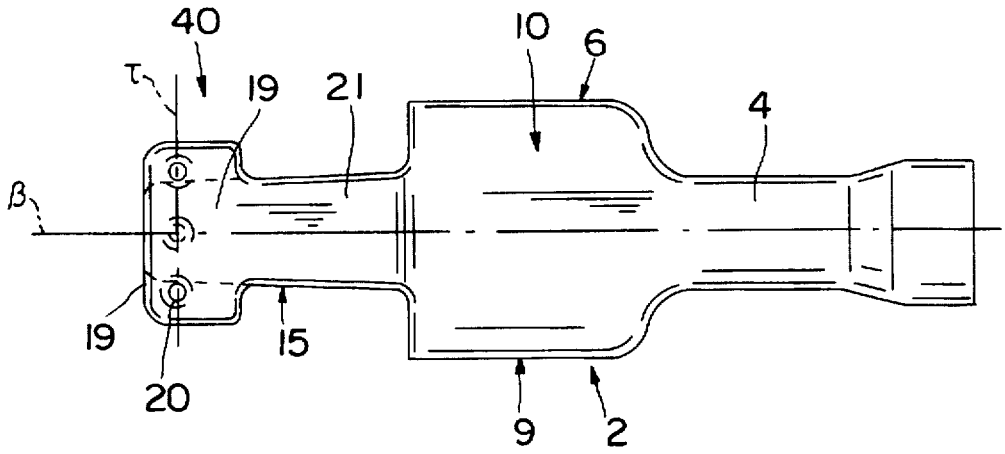
FIG. 9 shows a bottom plan view of a second embodiment of a female terminal in accordance with the teachings of the present invention.

FIG. 9 shows a terminal 40 according to a further embodiment of the present invention.

Any parts of terminal 40 identical or equivalent to those of terminal 1 are indicated using the same numbering system.

Terminal 40 is identical to-terminal 1 with the exception of blade 15.

In this case, blade 15 is substantially T-shaped and comprises an end portion 19 substantially similar to the end portion of blade 15 of terminal 1; and a deformable portion 21 substantially similar to deformable portion 18 of blade 14.

Figure 10:
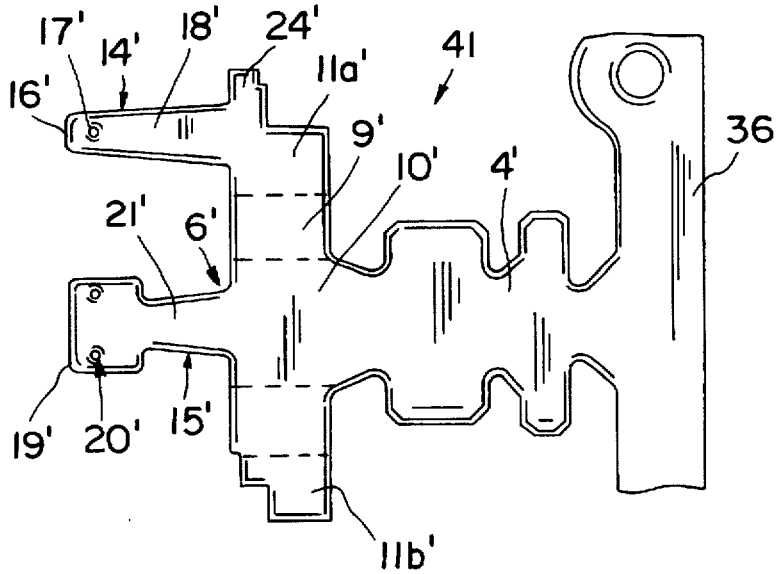
FIG. 10 shows a flat sheet metal blank from which to produce the FIG. 9 terminal.

FIG. 10 shows a blank 41 corresponding to terminal 40, and the various parts of which are indicated using the same numbering system as for blank 35.

Terminal 40 operates in exactly the same way and presents the same advantages as described with reference to terminal 1.

To those skilled in the art it will be clear that changes may be made to terminals 1 and 40 as described and illustrated herein without, however, departing from the scope of the present invention.

In particular, the blades need not necessarily present impressions defining the contacts.

In the case of blades with a flat cross section, the contact regions may be defined by simply curving the blades longitudinally, and contact with the flat surface of the male terminal is effected substantially along a generating line. The blades may also be curved transversely, in which case, contact is theoretically punctiform and in practice located in a circular area of tangency.

Finally, the female terminal according to the present invention permits the use of ridged-section male terminals turned over 180° in relation to that described, by appropriately adjusting the initial gap between the contact blades to achieve the required contact pressure.

We claim:

1. A female electric terminal made of conductive sheet metal and comprising, integrally, a contact body with contact means for cooperating with a male terminal, and a portion for connection to an electric cable, said contact means comprising first and second flexible blade means projecting from opposite walls of said contact body, extending on opposite sides of an insertion plane of said male terminal for cooperating elastically with respective opposite faces of said male terminal, said blade means defining, when undeformed, a gap smaller than a thickness of said male terminal, wherein said first and second blade means are asymmetrical in relation to said insertion plane of said male terminal so as to define transversely offset contact areas on respective faces of said male terminal, said first and second blade means comprising respective flexible portions having a substantially identical flexural rigidity, wherein said first blade means comprise a single first blade, and said second blade means comprise a single second blade, and said first blade having a width less than a width of second blade.

2. A female terminal as claimed in claim 1, wherein said contact body presents a box portion of closed rectangular cross section, adjacent to said connecting portion, and comprises a pair of walls parallel to said insertion plane of said male terminal, and a pair of lateral walls perpendicular to said insertion plane, said first and second blades being curved, with convexities facing each other and projecting integrally from said walls parallel to said insertion plane.

3. A female terminal as claimed in claim 1 or 2, wherein said first blade means defines a first contact having a center in a mid-longitudinal plane of said terminal, and said second blade defines two contacts located symmetrically in relation to said mid longitudinal plane of said terminal, and respective centers of which lie in a transverse plane through a center of said first contact.

4. A female terminal a claimed in claim 3, wherein said first blade and said second blade comprise respective end portions defining respective said contacts, said flexible portions integrally connecting said end portions to said respective walls of said contact body parallel to said insertion plane of said male terminal.

5. A female terminal as claimed in claim 3, wherein said flexible portion of said second blade presents an opening dividing said second blade into two side-by-side longitudinal portions, each of said portions having a rigidity equal to half the rigidity of the flexible portion of said first blade.

6. A female terminal as claimed in claim 3, wherein said second blade is substantially T-shaped, and said flexible portions of said first blade and said second blade are similar to each other.

* * * * *